United States Patent [19]

Kimmel

[11] 4,023,777

[45] May 17, 1977

[54] MIXER WITH ROTATING MIXING CONTAINER

[75] Inventor: Hans Kimmel, Detmold, Germany

[73] Assignee: Gunther Papenmeier KG, Maschinen-und Apparatebau, Detmold, Germany

[22] Filed: Nov. 4, 1975

[21] Appl. No.: 628,655

[30] Foreign Application Priority Data

Apr. 14, 1975 Germany ..... 2516255

[52] U.S. Cl. ..... 259/3; 259/84; 259/DIG. 5; 259/DIG. 6

[51] Int. Cl.[2] ..... B01F 15/00; B01F 9/08; B01F 9/10

[58] Field of Search ..... 259/3, 15, 32, 84, 104, 259/109, DIG. 5, DIG. 6

[56] References Cited

UNITED STATES PATENTS

| | | | |
|---|---|---|---|
| 2,036,112 | 3/1936 | Aeschbach | 259/DIG. 5 |
| 2,237,859 | 4/1941 | Bille | 259/DIG. 6 |

FOREIGN PATENTS OR APPLICATIONS

| | | | |
|---|---|---|---|
| 1,607,780 | 10/1969 | Germany | 259/3 |
| 2,063,326 | 12/1971 | Germany | 259/118 |
| 43-9798 | 8/1965 | Japan | 259/104 |

*Primary Examiner*—Harvey C. Hornsby
*Assistant Examiner*—Robert Pous
*Attorney, Agent, or Firm*—Strauch, Nolan, Neale, Nies & Kurz

[57] ABSTRACT

The present invention relates to a mixer having a substantially vertically arranged rotating container of cylindrical or frustoconical shape, and a rotating mixing screw arranged therein, the said screw having relative movement along the container wall and conveying the mix material upwards.

7 Claims, 2 Drawing Figures

MIXER WITH ROTATING MIXING CONTAINER

PRIOR ART

A mixer of this kind is shown in German Pat. No. 1,607,780 (Auslegeschrift); the mixing screw disclosed in that specification extends through the bottom of the container and terminates a short distance from the upper container rim. The mix material is conveyed upwards by the mixing screw and falls downwards after issuing from the mixing screw. The advantage of a mixer of that kind is that it avoids dead zones in the mix material and an intensive mixing effect is obtained even with very small charge batches (loads) in containers of large dimensions. Such a mixer, however, only allows batchwise operation and does not allow continuous mixing with a continuous throughflow method. In German Pat. No. 2,063,326 (Auslegeschrift), a mixer is known with a vertically stationary mixing container and two rotating mixing screws arranged therein. These mixing screws additionally carry out a circulating movement about the container axis, so that the mix material is given a rotating movement and rises upwards at the container wall. As a result a very large mix material surface area is presented to a spraying nozzle arranged in the middle of the container for introducing a liquid additive. For emptying, the mixing container must either be tipped or a bottom outlet must be provided for the mix material. Continuous operation is also not possible with the mixer.

Owing to the difficulties in supplying and discharging material and the adjustment of the throughflow time and the mixing effect, prior constitutional forms with mixing drums arranged in a horizontal or slightly inclined manner have been used for continuously operating mixers.

Two types can be distinguished, namely mixers with rotating drums such as are described for example in German Pat. No. 560,841; German Pat. No. 530,962; German Pat. No. 824,169 and German Pat. No. 561,266. In these, the mix material is taken upwards by the rotation of the drum at the drum wall region and falls down again in the form of curtain to the bottom of the drum. By means of guide plates or rotating mixing shafts, an influence is exerted on the advance and the mixing of the mix material.

In the other type of mixers of this kind the drum is stationary and the advancing movement of the mix material and the mixing of the material are brought about only by rotating mixing shafts which are arranged in the drum. Thus the German Pat. No. 1,146,852 describes a mixer having a mixing drum in which a mixing shaft is arranged with vanes fixed thereon, almost filling the entire cross-section of the drum. The vanes are so adjusted as regards pitch that the mix material is subjected to a feeding movement alternately in the direction of throughflow and in the opposite direction. This "pilgrim step" (e.g. back one step forward two) type of feed brings about a good mixing action. The throughflow quantity can be influenced by the inclination of the drum and the rotational speed of the mixing shaft. The mixing effect itself cannot be adjusted independently of the throughflow quantity.

German Pat. No. 1,607,775 (Auslegeschrift) describes a mixer having a horizontal mixing drum in which there are arranged two rotating mixing screws which carry out a planetary movement about a common axis. The two screws convey in different directions and enter the mix material alternately. They are driven by a common motor. The throughflow quantity cannot be influenced independently of the mixing effect in this mixer either. All mixers using a substantially horizontal mixing drum have sealing problems since the drums have to be closed in some suitable manner at the ends and yet on the other hand the mixing screws or operating devices for adjustable guide plates must be taken through these ends. The sealing elements for the places where the shafts are taken through the drum ends are subjected to the influences of the mix material, the mix material can enter these, and frequent cleaning is necessary. In addition, none of the known mixers allows the mixing effect and the throughflow quantity to be adjusted independently of one another.

OBJECTS OF THE INVENTION

The present invention has as its object a mixer for continuous operation wherein there are no problems with shaft guide bushings or the like and wherein the mixing effect and the throughflow quantity can be adjusted independently of one another.

The invention uses a known mixer of the type initially specified; this mixer is constructed according to the invention in such a manner that in the container there is arranged at least a second mixing screw which sweeps the container wall and conveys the mix material downwardly, a charging device opening into the vicinity of the container bottom, and at the upper end of the first mixing screw a discharge device, the rotational speed of the container and the rotational speeds of the mixing screws being adapted to be adjusted independently of one another.

The rotational movement of the container presses the mix material against the container wall; this is promoted by projections, ribs or the like which are arranged on the bottom of the container, or by means of a separately driven mixing blade. The mixing screws convey the mix material upwards and downwards alternately, with the upwardly directed component of movement being greater than the downward. In this way the mix material is given a "pilgrim step" kind of advancing movement along the container wall in an upward direction. Owing to this pilgrim step type of advancing movement for the mix material, a good, intensive mixing of the material is obtained. Associated with the upper end of the upwardly conveying mixing screw is a discharge device with which the mix material can be discharged from the container, the said material then moving along the container wall, being thoroughly mixed in the process, and finally discharged at the upper edge of the container.

Each mixing screw, and the container, are given their own drive. By increasing the rotational speed of the container it is possible to influence the throughflow quantity of the mix material. By adjusting the mixing screw rotational speeds, it is possible to adjust the resulting step distance over which a particle of the mix material is moved during one revolution of the container by the mixing screws. Thus it is possible to keep the mixing effect constant although the container speed rises and thus the throughflow quantity increases. This distinguishes the mixer according to the present invention from all previously known continuous throughflow mixers operating with a pilgrim step method.

For constructional reasons it is advantageous if the mixing screws are situated diametrically opposite one another. It is also advantageous if the screw helixes of the mixing screws which convey in different directions have opposite directions of pitch relatively to one another. In this way each mixing screw from the outset has a preferred conveying direction owing to the helix approach angle presented to a particle of mix material rotating in the vicinity of the mixing container wall. Even with the mixing screws stopped, this will produce a pilgrim step advancing movement in the mix material.

It is also possible to provide more than two mixing screws in the container, for example four mixing screws of which mixing screws which convey in the same direction are preferably situated diametrically opposite one another. Screws which convey in the same direction can also be given a common drive. But all the drives must be capable of adjustment independently of one another as regards rotational speed.

PREFERRED EMBODIMENT

The invention will be explained in detail with the help of two constructional examples which are shown in the drawings wherein.

Figure 1:
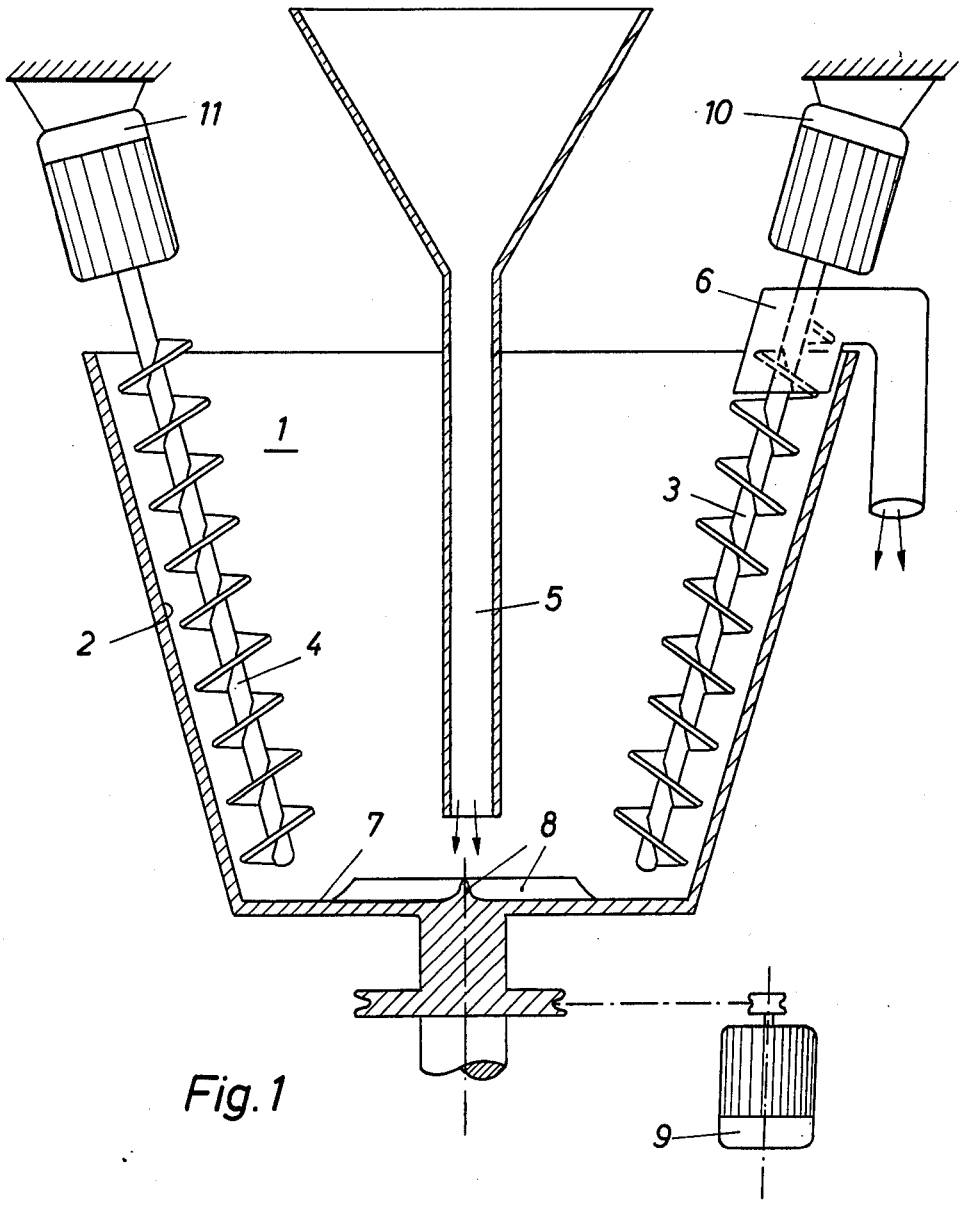
FIG. 1 shows a mixer with two screws wherein ribs are constructed on the bottom.

Reference should be made first of all to FIG. 1. Two mixing screws 3 and 4 which sweep the container wall 2 are arranged diametrically opposite one another in a frustoconical mixing container 1. In the vicinity of the container bottom 7 is the delivery end of a charging device 5 for the mix material, and at the upper end of the upwardly conveying mixing screw 3 there is arranged a discharge device 6 for the mix material. The container 1 rotates about its axis and is driven by a motor 7. The mixing screws 3 and 4 are held in a stationary position and each driven by motors 10 and 11 respectively. Constructed on the bottom 7 of the mixing container 1, are ribs 8 which are intended to throw outwardly the mix material in a radial direction.

The mixing container rotates and in so doing drives the mix material on to the upwardly widening container wall 2. The mix material rises upwards along the said wall. The rotational speed of the container is preferably adjusted so that the gravitational force which acts on the mix material is balanced by the upward driving component produced in the mix material by the inclination of the container wall, that is to say at this rotational speed the mix material lies against the container wall in an approximately stationary condition. The first mixing screw 3 is driven in such a manner that an upwardly directed component of movement is given to the mix material. The second mixing screw 4 is so driven that a downwardly directed component of movement is imparted to the mix material. The mix material is thus conveyed upwards and downwards stepwise as the container rotates, and the steps are so adjusted that the upward conveying action is the dominant one. As a result the mix material is advanced with a kind of pilgrim step movement along the container wall, giving a very intensive mixing effect. At the upper end of the first mixing screw 3 the mix material is taken from the container and discharged towards the outside by the discharge device 6. This is effected continuously so that the charging device 5 can also introduce mix material continuously into the mixing container 1.

In the illustrated constructional example the screws have different directions of pitch. A particle of mix material which impinges against the mixing screws between the screw axis and the container wall is deflected by one mixing screw in an upward direction and by the other mixing screw in a downward direction even if the mixing screws are not rotating. The steps which are produced in this way are quite small; they become larger if the mixing screws rotate.

To obtain a strict equilibrium between the weight of the mix material and the upward driving force, theoretically, a parabolic cross-sectional form would be necessary for the container wall 2; however, with solid granular material there is sufficient internal friction in the mix material so that the parabolic form of container cross-section can be dispensed with. Furthermore, the pitches of the screw helixes may be non-uniform over the length of the mixing screws in order to compensate for irregularities in the upward drive on the mix material caused by the laws of centrifugal force.

Figure 2:
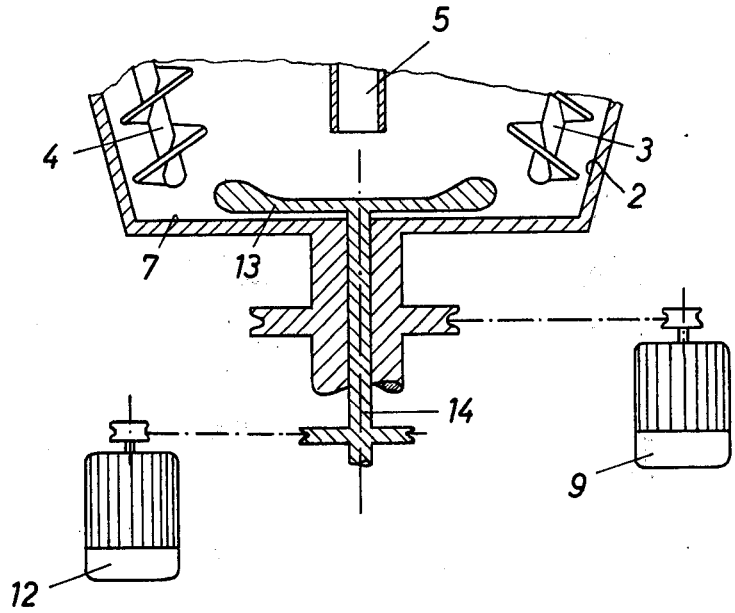
FIG. 2 shows a mixer of the type shown in FIG. 1 but wherein a separately driven projecting blade is arranged in the vicinity of the container bottom.

The constructional example shown in FIG. 2 differs from that shown in FIG. 1 in that instead of ribs there is arranged in the vicinity of the bottom 7 of the mixing container a projecting or centrifugal blade 13 whose shaft 14 extends through the bottom 7 and is driven by its own motor 12. This blade 13 is mainly intended to ensure that the mix material is thrown against the container wall 2. This kind of mixer construction brings the additional advantage that the mix material is reliably fed towards the container wall even if the container is running at a slow rotational speed.

It should be particularly pointed out that the invention can also be used with cylindrical mixing containers. In such mixers it is true that usually there is not such a uniform distribution of mix material in the container as with a frustoconical constructional form, and the distribution of mix material in the container obeys a parabolic function. But this can be taken into account by varying pitches of helixes along the screw axes in such a manner that in the lower region a relatively stronger conveying action is obtained than in the upper region. It should also be pointed out that inclination of the complete arrangement towards the discharge device may also be advantageous since in this way the discharge of the mix material is promoted.

What is claimed is:

1. Mixer having a rotatable container for mixing material and at least two rotatable mixing screws disposed therein and closely adjacent the container wall for sweeping the container wall; a first one of said screws being constructed and rotatable in a manner to convey material within the container in a first direction, a second one of said screws being constructed and rotatable in a manner to convey material within the container in a substantially opposite direction; means for rotatably driving the container and each of the mixing screws at speeds adjustable independently of one another; an input means for said container to introduce material to be mixed having an outlet opening near one end of the interior of the rotatable container; a container output means located adjacent one of the screws and disposed to receive material within the container, which will be conveyed by rotation of that associated screw, and to discharge the received material from the container.

2. Mixer according to claim 1, in which the mixing screws are situated diametrically opposite one another relative to the rotational axis of the container.

3. Mixer according to claim 1 in which the helixes of the rotatable screws which are adapted to convey material in different directions have directions of pitch opposite to one another.

4. Mixer according to claim 1, wherein the one end of the container is a container bottom and projections are provided on the interior of said container bottom.

5. Mixer according to claim 1, in which, in the region of said container bottom, a rotatable centrifugal blade is arranged within the container, and means mounting said blade enables said blade to be rotatable driven independently of the container.

6. Mixer according to claim 1, wherein: the container is rotatable about a substantially vertical axis; said one end of the container is a container bottom; said first screw is constructed and rotatable in a manner to convey material from the upper portion of the container toward the container bottom; said second screw is constructed and arranged to convey material from adjacent the container bottom to adjacent the upper portion of the container; and said output means is associated with said second screw.

7. Mixer according to claim 6, wherein the interior cross-sectional area at the top of said container is larger than the interior cross-sectional area adjacent the bottom of the container.

* * * * *